US007079083B2

(12) United States Patent
Gottl et al.

(10) Patent No.: US 7,079,083 B2
(45) Date of Patent: Jul. 18, 2006

(54) ANTENNA, IN PARTICULAR A MOBILE RADIO ANTENNA

(75) Inventors: Maximilian Gottl, Frasdorf (DE); Magnus Hubner, Hohenlinden (DE); Felix Micheel, Rosenheim (DE); Michael Boss, Riedering (DE)

(73) Assignee: Kathrein-Werke KG, Rosenheim (DE)

( * ) Notice: Subject to any disclaimer, the term of this patent is extended or adjusted under 35 U.S.C. 154(b) by 81 days.

(21) Appl. No.: 10/999,156

(22) Filed: Nov. 30, 2004

(65) Prior Publication Data

US 2006/0114168 A1 Jun. 1, 2006

(51) Int. Cl.
*H01Q 21/26* (2006.01)
*H01Q 21/00* (2006.01)

(52) U.S. Cl. ..... 343/797; 343/810

(58) Field of Classification Search ..... 343/797, 343/810, 846, 770, 808, 813, 893, 911 R, 343/702, 700 MS
See application file for complete search history.

(56) References Cited

U.S. PATENT DOCUMENTS

| | | | | |
|---|---|---|---|---|
| 4,081,803 | A | 3/1978 | Dempsey | |
| 5,485,167 | A | 1/1996 | Wong et al. | |
| 6,433,756 | B1 * | 8/2002 | Sievenpiper et al. | 343/909 |
| 6,452,549 | B1 * | 9/2002 | Lo | 343/700 MS |
| 6,930,650 | B1 * | 8/2005 | Gottl | 343/810 |
| 6,933,906 | B1 * | 8/2005 | Stolle et al. | 343/797 |

FOREIGN PATENT DOCUMENTS

| | | |
|---|---|---|
| CA | 2 430 105 | 6/2002 |
| DE | 198 23 749 A1 | 12/1999 |
| DE | 198 60 121 A1 | 7/2000 |
| DE | 100 64 129 A1 | 7/2002 |
| DE | 102 17 330 A1 | 5/2003 |
| EP | 0730319 A1 | 9/1996 |
| EP | 0 785 595 A1 | 7/1997 |
| WO | 03/065505 A1 | 8/2003 |
| WO | WO03/065505 A1 | 8/2003 |

OTHER PUBLICATIONS

International Search Report dated Jan. 19, 2006 recently issued in a counterpart foreign application, 2 pages.

* cited by examiner

*Primary Examiner*—Tuyet Vo
*Assistant Examiner*—Minh Dieu A
(74) *Attorney, Agent, or Firm*—Nixon & Vanderhye P.C.

(57) ABSTRACT

An antenna, in particular a mobile radio antenna, operates in at least two frequency bands. Two or more dipole antenna elements are provided and are arranged in front of a reflector, which transmit and receive in two different frequency bands. The distance between the antenna element structure, the antenna elements or the antenna element top of at least one dipole antenna element for the higher frequency band is at a distance from the reflector plane which corresponds to at least 75% and at most 150% of the distance between an antenna element structure. An antenna element or an antenna element top of at least one dipole antenna element for the lower frequency band and the reflector plane, and/or the distance between the antenna element structure, the antenna elements or the antenna element top of at least one dipole antenna element for the higher frequency band is at a distance from the reflector plane which is greater than 0.4λ and is preferably less than 2λ with respect to the mid-frequency of the antenna element for the higher frequency.

27 Claims, 9 Drawing Sheets

ANTENNA, IN PARTICULAR A MOBILE RADIO ANTENNA

TECHNICAL FIELD OF THE INVENTION

The invention relates to an antenna, in particular a mobile radio antenna, for operation in at least two frequency bands.

BACKGROUND OF THE INVENTION

Multiband antennas which allow reception and transmission of radiation in at least two different frequency ranges are known from the prior art. By way of example, the document DE 198 23 749 A1 discloses a dual-polarized multiband antenna which has first and second antenna elements. The first and second antenna elements transmit and receive in different frequency ranges and comprise dual-polarized dipole antenna elements which are arranged on a reflector and transmit and receive in polarizations which are aligned at +45° and −45° to the vertical. In the case of the multiband antenna which is disclosed in this document, the first antenna elements are in the form of cruciform dipoles which transmit and receive in an upper frequency band. The antenna elements in the lower frequency band are dipole squares, with one cruciform dipole being arranged in each dipole square. The radiation characteristics of the first and second antenna elements can be varied by appropriate shaping of the reflector, although it is not possible to simultaneously optimize the radiation characteristics for the upper and lower frequency bands.

SUMMARY OF THE INVENTION

The object of the invention is therefore to create an antenna which operates in a number of frequency bands and allows improved radiation characteristics in each frequency band.

This object is achieved by the antenna according to the independent claim. Developments of the invention are defined in the dependent claims.

The antenna according to the invention has two or more antenna elements which are arranged in front of an electrically conductive and preferably metallic reflector, which is in the form of a flat surface and forms the reflector plane. The antenna elements each have one or more radiation edges and/or one or more elements in the form of rods, which represent the major parts of the dipole antenna elements and which are also referred to in some cases in the following text as the antenna element structure or dipole antenna element structure. The antenna elements are furthermore each on a radiation plane on which radiation edges and/or the elements of the antenna element which are in the form of rods are arranged, with each radiation plane being essentially parallel to the reflector plane, or being inclined at most at an angle of ±5° to the reflector plane. In order to transmit and receive in at least two frequency bands, first and second antenna elements are provided, with one or more of the first antenna elements being on a common first radiation plane, and one or more of the second antenna elements being on a common second radiation plane, and transmitting and receiving in different frequency bands. In this case, the first antenna elements are operated in an upper frequency band, and the second antenna elements are operated in a lower frequency band. The antenna according to the invention is distinguished by the distance between the first radiation plane and the reflector plane being at least 90% and at most 150% of the distance between the second radiation plane and the reflector plane.

Since the distance between the first antenna elements, which operate in the upper frequency band, is approximately the same as or greater than the distance between the second antenna elements, this results in a better radiation characteristic, in particular for the antenna element for the upper frequency band.

The solution according to the invention results in an extremely compact design. Finally, the solution according to the invention results in further design options for the polar diagram, that is to say for the shape of the polar diagram, and in this case in particular for the upper frequency band. The 3 dB beamwidth can thus be varied particularly advantageously within the scope of the invention, as well, the back-to-front ratio improved and improved sidelobe attenuation realized.

In one preferred embodiment of the invention, the first and the second radiation plane are essentially at the same distance from the reflector plane.

In order to separate the first antenna elements, which operate in the upper frequency band, from the reflector plane, platforms are used in one particularly preferred embodiment of the invention, which are connected to the reflector and are preferably at least partially electrically conductive. In this case, one first antenna element is arranged on each platform. The platform may in this case be referred to either as a platform or as an auxiliary reflector, which has a longitudinal and transverse extent in the longitudinal and transverse direction parallel to the reflector which is greater than the cross section of the base or of the balancing for the associated dipole antenna element.

On their upper face, the platforms preferably have an electrically conductive and preferably metallic platform upper face or platform, on each of which a first antenna element is positioned.

Finally, so-called flaps or extensions in the form of flaps, can be provided offset in the circumferential direction on the boundary edges of the platform, that is to say preferably on the upper level of the platform on which the associated antenna element is held via its base. These flaps may be positioned such that they run upwards and obliquely outwards with respect to the vertical at any desired angle, for example at an angle of 20°. These flaps may, however, also be in the form of flaps which lie on the same plane as the platform surface, that is to say in other words they are parallel to the reflector plane, project outwards and effectively extend the platform area. The flaps may also likewise be angled downwards. In other words, the flaps can be positioned at any desired angular positions to the vertical, from 0°, for example at +10°, with respect to the vertical pointing away from the reflector plane, up to 180°, for example 170°. Finally, the flaps may be provided at a distance from one another only on the side wall sections of the platform, such that an open angle area remains in corner areas between two adjacent flaps. However, the flaps may just as well also be in the form of a circumferential boundary or a wall on the platform, above which the associated antenna element projects upwards. Finally, however, it is possible to dispense with the flaps completely.

The flaps—when they are provided—preferably have specific length and transverse dimensions in order to achieve optimization. The antenna element standing on the platform may be mounted with its base on the upper face of the platform. The platform and base of the associated antenna element may, however, also be integral, with the conductive or metallic surface which projects at the side beyond the base then being provided at an appropriate height, in which case it may be referred to as the platform upper face, the plateau or the auxiliary reflector.

In a further embodiment of the invention, one or more first antenna elements are each arranged essentially centrally within a second antenna element in a plan view of the reflector. Furthermore, one or more first antenna elements are preferably each arranged essentially centrally between adjacent second antenna elements in a plan view of the reflector. The arrangement in a plan view thus corresponds essentially to the arrangement disclosed in the document DE 198 23 749 A1.

Further radiation planes may also exist in addition to the first and the second radiation plane, on which the radiation edges and/or the elements, which are in the form of rods, of first and/or of second antenna elements are arranged. This allows the radiation field of the antenna to be adapted further.

One or more second antenna elements may, for example, be dual-polarized dipole squares formed from four dipoles, for example as disclosed in the already cited DE 198 23 749 A1. The second antenna elements may in particular also be cup-shaped, dual-polarized antenna elements, which have radiation edges or elements in the form of rods at the end which is remote from the reflector. In particular, the second antenna elements may assume any embodiment which is described in the document WO 03/065505 A1. The cup-shaped antenna elements preferably have two or more surface elements over their entire surface, which run obliquely and/or at right angles to the reflector plane and whose boundary edge remote from the reflector plane is a radiation edge. In a further preferred embodiment, a first antenna element is in each case arranged in one or more of the dipole squares and/or cup-shaped antenna elements, in a plan view of the reflector.

One or more first antenna elements are preferably dual-polarized cruciform dipoles and/or vector dipole antenna elements. Cruciform dipoles are disclosed, by way of example, in DE 198 23 749 A1, and the design of vector dipole antenna elements is known from the document DE 198 60 121 A1.

In a further embodiment of the invention, the reflector has side walls which run in the longitudinal direction of the reflector and extend obliquely and/or at right angles from the reflector plane, with the two or more antenna elements being arranged between the side walls.

Possible side walls may be provided in the normal manner on the reflector (which are provided located on the outside or offset somewhat inwards) at an appropriate height and aligned at an angle, in order in this way to also shape the polar diagram.

In a further refinement of the antenna according to the invention, the mid-frequency of the lower frequency band is essentially half the mid-frequency of the upper frequency band. Furthermore, a large number of first and second antenna elements are preferably arranged in the longitudinal direction of the reflector, with a first antenna element being arranged essentially centrally above each second antenna element, and a first antenna element in each case being arranged essentially centrally between each pair of adjacent second antenna elements.

In a further embodiment, all of the first antenna elements are arranged on the first radiation plane, and all of the second antenna elements are arranged on the second radiation plane.

The antenna according to the invention is preferably a mobile radio antenna whose frequency bands are, in particular, in the GSM, in the CDMA and/or for example in the UMTS mobile radio frequency range.

BRIEF DESCRIPTION OF THE DRAWINGS

Exemplary embodiments of the invention will be described in detail in the following text with reference to the attached figures, in which.

DETAILED DESCRIPTION OF THE INVENTION

Figure 1:
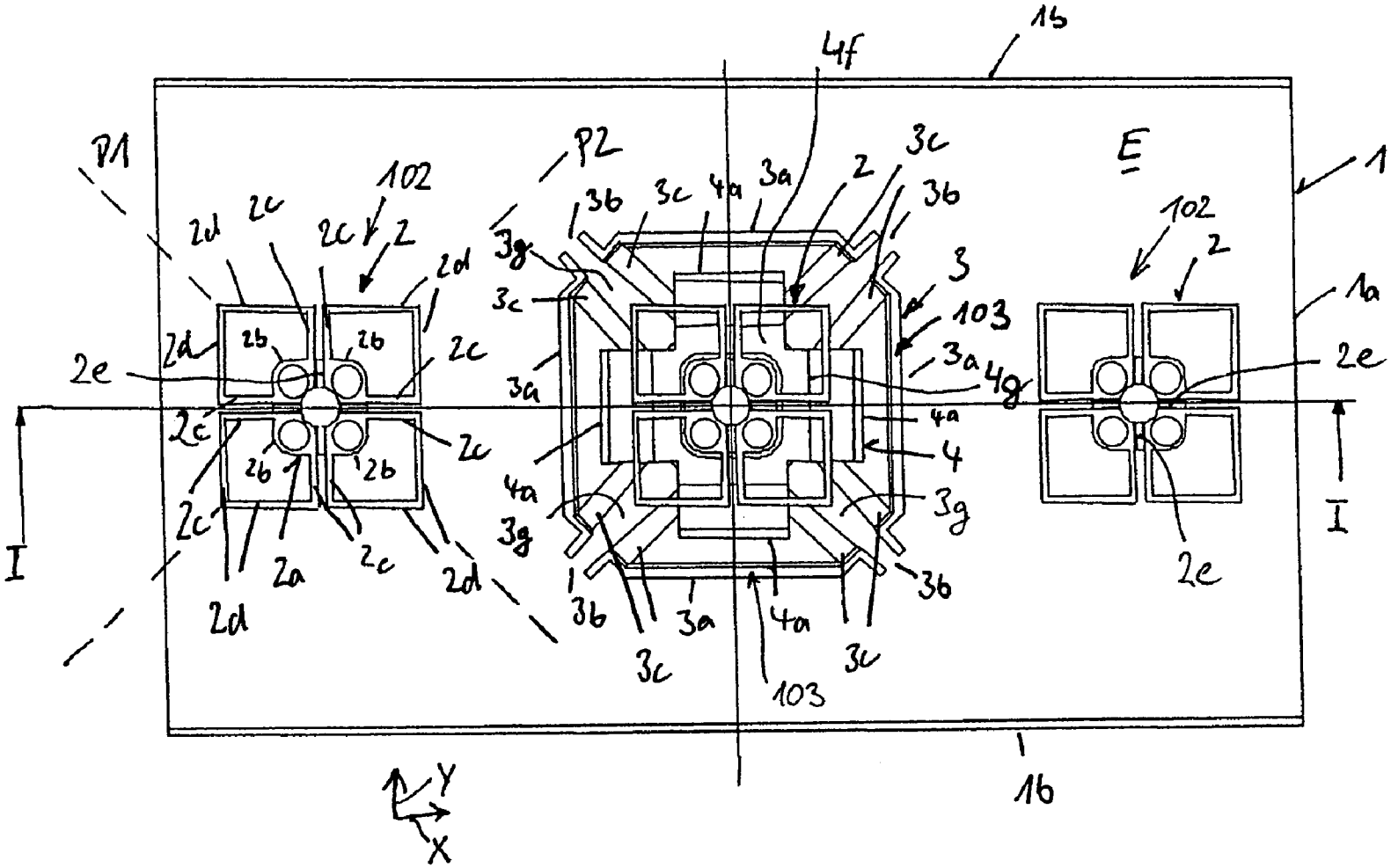
FIG. 1: shows a plan view of a detail of one embodiment of the antenna according to the invention.

FIG. 1 shows a plan view of a detail of a reflector plate 1, which is referred to for short in the following text as a reflector 1, and extends in the X direction. The X longitudinal direction normally corresponds to the vertical direction of the antenna. The reflector has an essentially planar reflector bottom 1*a*, which forms the reflector plane E. The reflector plate also has two side walls 1*b*, which run in the longitudinal or vertical direction X, project vertically, or such that they run at an angle to the vertical, from the plane E of the reflector, and can bound the outer edge of the reflector although they may also just as well be arranged offset further inwards from the outer edge. In FIG. 1, two types of antenna elements are arranged on this reflector 1. The first antenna element type comprises a dipole antenna element 2 in the form of a vector dipole antenna element. Three antenna elements of this type are shown in FIG. 1, which are arranged at equal intervals alongside one another in the longitudinal direction X and transmit and receive in an upper frequency band, for example in the range from 1700 MHz to 2500 MHz. The design and principles of operation of vector dipole antenna elements are well known from the prior art and are described in particular in the document DE 198 60 121 A1, whose entire disclosure content is included by reference in the content of this application.

Figure 2:
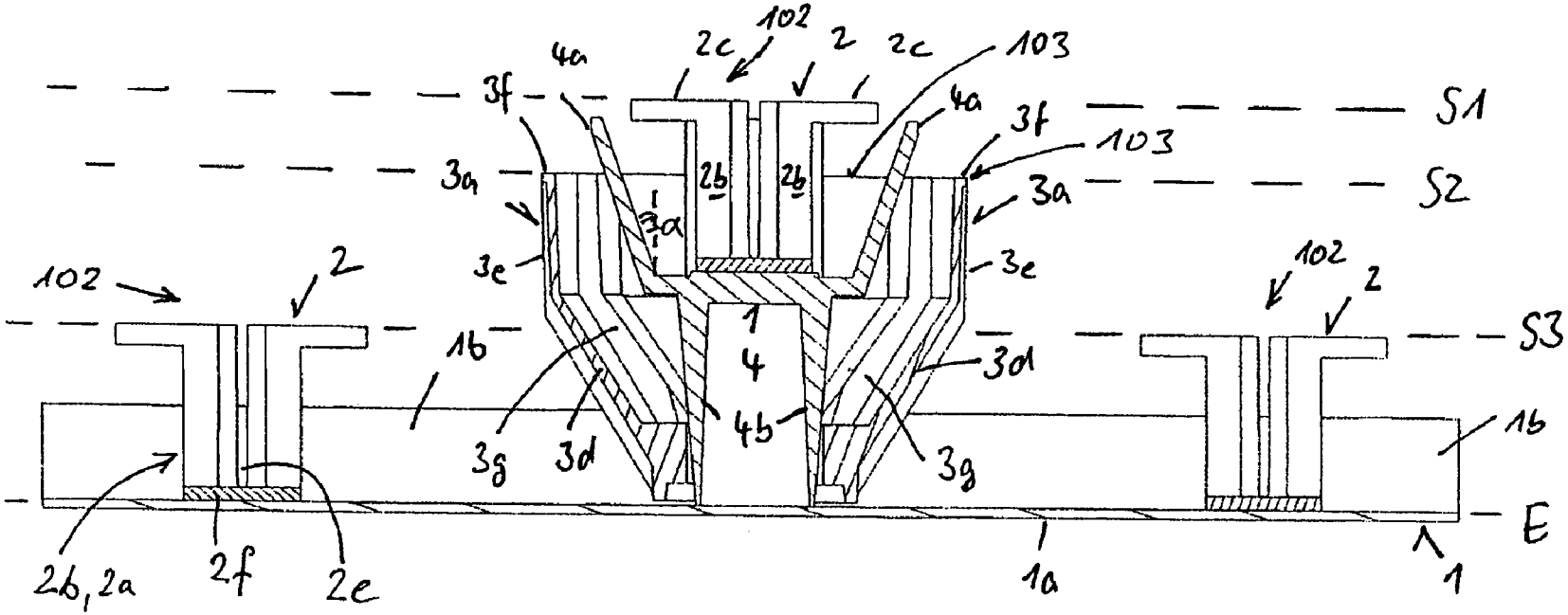
FIG. 2: shows a section view along the line I—I in FIG. 1.

The vector dipole antenna elements each have a base 2*a* which extends at right angles to the reflector plane E and is in turn formed by a balancing means 2*b*, which is designed in such a way that axial cuts which run from the top in the direction of the reflector plane E and are generally aligned at right angles to the reflector 1, and which, for example, have a length of $\lambda/4$ are introduced into the base 2*a*, and are electrically conductively connected to the antenna elements remotely from the reflector plane. The axial cuts 2*e* in this case extend virtually as far as the reflector plane E, that is to say as far as a so-called base bottom 2*f* (FIG. 2). At the upper end of each balancing means 2*b*, two lines 2*c* are provided which are at right angles to one another and run parallel to the reflector plane E, with half-dipole components 2*d* being arranged at each front end of the lines 2*c*, being at right angles to the respective line, and likewise running parallel to the reflector plane E. From the electrical point of view, the vector dipole antenna element is constructed in the same way as a cruciform dipole, which in each case comprises two mutually perpendicular dipole halves which transmit and receive in the first polarization plane P1 or P2, respectively (FIG. 1). An antenna element structure such as this which from the electrical point of view forms a dipole half is in each case formed in the vector dipole, from the design point of view, from two mutually perpendicular half-dipole components 2*d*, with the ends of the symmetrical or essentially or approximately symmetrical lines which lead to the respective dipole halves being connected such that the corresponding line halves of the adjacent mutually perpendicular dipole halves are always electrically connected. The electrical feed for the respective diametrically opposite dipole halves is provided such that a first polarization and a second polarization, which is orthogonal to the former, are decoupled. The vector dipole antenna elements thus, from the design point of view, form a dipole square, but from the electrical point of view transmit and receive with a +45° polarization P1 and a −45° polarization P2.

The dipoles or half-dipole components which are shown for the antenna element 2 in the end form the dipole structure 102, the antenna elements 102 or the antenna element top 102 which essentially govern and influence the polar diagram of this type of antenna element.

A second antenna element in the form of a dual-polarized, cup-shaped dipole antenna element 3 is used as a second type of dipole antenna element. This dipole antenna element is likewise well known from the prior art and is described in particular in WO 03/065505 A1, whose entire disclosure is included by reference in the content of this application. The cup-shaped dipole antenna element 3 in the illustrated exemplary embodiment has four surface elements 3*a* over its entire surface, with the boundary edges 3*f* (see FIG. 2) which are remote from the reflector bottom 1*a* of the surface elements forming the dipole antenna elements or the antenna element structure, antenna elements 103 or antenna element top 103 which is or are essential to the polar diagram. The surface elements 3*a* are electrically fed at four feed points 3*b*, with the feed to the feed points being at least approximately in-phase and approximately balanced. This makes it possible for the dipole antenna element 3—analogously to the dipole antenna elements 2—to transmit and receive with the +45° polarization P1 and the −45° polarization P2. As is disclosed in WO 03/065505 A1, the feed to the feed points 3*b* is in each case provided, however, such that the outer conductor is in each case electrically connected to one end of a corresponding antenna element 3*a*, and the inner conductor is connected to the adjacent end of an adjacent antenna element 3*a*, which is aligned rotated through 90°. A gap or slot 3*g*, which should be considered from the prior publication cited above as already being known, then also runs between two such antenna elements as explained, and runs as far as a lower base section, adjacent to the reflector plane E.

The individual surface elements 3*a* of the antenna element 3 are trapezoidal and run essentially obliquely from the reflector bottom 1*a*. The edges of the surface elements 3*a*, which run obliquely from the reflector bottom, furthermore have bends 3*c*, with a gap being formed between adjacent bends. This shaping and arrangement of the surface elements results in the cup-shaped form of the dipole antenna element 3. In this case, it should be noted that other types of cup-shaped dipole antenna elements may also be used in the antenna according to the invention. In particular, the surface elements 3*a* need not cover the entire surface, but may have a frame structure formed from two or more rods. In particular, all the dipole antenna element forms which have been described in the already cited application WO 03/065505 A1 are feasible for use in the present invention.

The second antenna element 3 transmits and receives in a lower frequency band, whose mid-frequency is essentially half the mid-frequency of the first antenna element 2, that is to say for example it can transmit and receive in the 900 MHz band, that is to say in the range from 800 MHz up to, for example, 1000 MHz.

In the exemplary embodiment which is illustrated in FIGS. 1 and 2, the figures show an antenna element 3 with the associated antenna element structure 103 for the lower frequency band, in addition to the three antenna elements 2, which are shown for the higher frequency band, with the associated antenna element structure 102. The central antenna element 2 for the higher frequency band is in this case arranged centrally within the cup-shaped second antenna element 3 in a plan view, with this antenna element 2 being arranged on a platform 4, so that the plane of the lines 2*c* and, in particular, the half-dipole components 2*d* and that the antenna elements or antenna element structure 102 in the illustrated exemplary embodiment is or are located above the upper edge of the cup-shaped antenna element 3, as will be explained in more detail in the following text with reference to FIG. 2. The platform 4 is preferably composed of an electrically conductive material, or is at least provided with a conductive top layer. The platform thus has an upper face which is aligned parallel to the reflector plane, or at least essentially parallel to the reflector plane E. The platform upper face 4*f* thus forms a plateau 4*f*, which in some cases is also referred to in the following text as an auxiliary reflector 4*f*. The size of the auxiliary reflector 4*f* is larger than the base cross section. As can be seen from the drawings, the platform upper face in the illustrated exemplary embodiment is essentially rectangular or square, in which case recesses can be provided in the corner areas (as is also evident from the plan view shown in FIG. 1). The longitudinal extent of the platform upper face or of the plateau 4*f* in this case has a longitudinal size in the X direction or vertical direction of the reflector 1 which corresponds at least to $\lambda/4$ and to a maximum of $\lambda$, with the smallest value of $\lambda$ corresponding to the wavelength at the lower band limit (lower frequency) of the upper frequency band. The highest value of $\lambda$ corresponds to that value for the upper band limit (highest frequency) with respect to the upper transmitted frequency band. The dimensions transversely with respect to the X direction or vertical direction of the reflector are chosen in a corresponding manner. One preferred value for the lower longitudinal or transverse extent for the diameter of the plateau surface is, for example, $\lambda/4$ for a frequency of 2.5 GHz.

As is also evident from the drawings, so-called flaps 4*a* are provided on the boundary faces or edges 4*g* of the platform upper face 4*f* or of the plateau 4*f*, and these will be described in more detail later. However, it may be stressed even at this point that the platform upper face 4*f* may have different forms, for example it may be square, rectangular, generally polygonal with n sides or else curved, that is to say round, with the platform surface in each case being designed to be larger than the base cross section of the corresponding antenna element.

FIG. 2 shows a section view along the line I—I in FIG. 1. FIG. 2 shows, once again but in more detail, the design of the cup-shaped antenna element 3 and of the platform 4 which is arranged in it. This shows in particular that the individual surface elements 3*a* comprise a lower section 3*d* which runs obliquely upwards and adjacent to whose upper end there is a section 3*a* which runs at right angles to the reflector plane E and ends at upper boundary edges 3*f* which form the dipole antenna elements of the antenna element 3. The figure also shows that the platform 4 has side walls 4*b* which run downwards to a point, and is hollow in the interior. The vector dipole antenna element 2 is arranged centrally on the platform, and the flaps 4*a* which run obliquely upwards also extend from the platform.

The use of the platform means that the half-dipole components of a vector dipole antenna element 2 arranged on the platform lie on a first radiation plane S1 which is in the vicinity of the radiation plane S2 that is formed by the boundary edges 3*f* of the cup-shaped antenna element 3. In the illustrated exemplary embodiment, the plane S1 is at a higher level than the plane S2. However, it is also feasible for the plane S1 to be essentially at precisely the same height as the plane S2, or else to be arranged somewhat below the plane S2. In particular, the distance between the plane S1 and the reflector plane E is in a range between 75% and 150% of the distance between the plane S2 and the reflector plane E. This lower limit may, however, also be 80%, 90%, 100% or even 110%. The corresponding upper limit may likewise be 140%, 130% or 120%. FIG. 2 also shows a third radiation plane S3, on which the dipoles of the left-hand and right-hand vector dipole antenna element 2 are located. The plane S3 is located at a significantly lower level than the planes S1 and S2, since the left-hand and right-hand antenna elements 2 are not located on a platform. However, it is also feasible for the left-hand and right-hand antenna elements 2 also to be arranged on a corresponding platform 4, as will be described in more detail in the following text.

The use of a platform which separates a dipole antenna element 2 which transmits and receives in an upper frequency band from the reflector plane E can advantageously influence the radiation behavior, in particular the 3 dB beamwidth of the radiation in the upper frequency band. If the platform 4 is appropriately shaped, it can also act as a second reflector for the antenna elements located on the platform, and this can also have a positive influence on the radiation behavior.

The antenna element 2 which is arranged centrally in the antenna element 3 for the low frequency band on the platform 4 in a plan view, for the higher frequency band is arranged with its antenna elements, antenna element top or, in general, its antenna element structure 102 at a height above the reflector plane E, at least in the area of this antenna element, which is greater than 0.4λ, where λ is the mid-wavelength for the mid-frequency of the antenna element 2 which is provided for the higher frequency band range. However, this lower limit may also be 0.6λ, 0.8λ, 1.0λ or, for example, 1.2λ or more. On the other hand, the distance from the reflector plane E should also not be greater than 2λ, although this upper limit may also be 1.8λ, 1.6λ or 1.4λ. Once again, λ relates to the mid-frequency of the upper frequency band.

Figure 3:
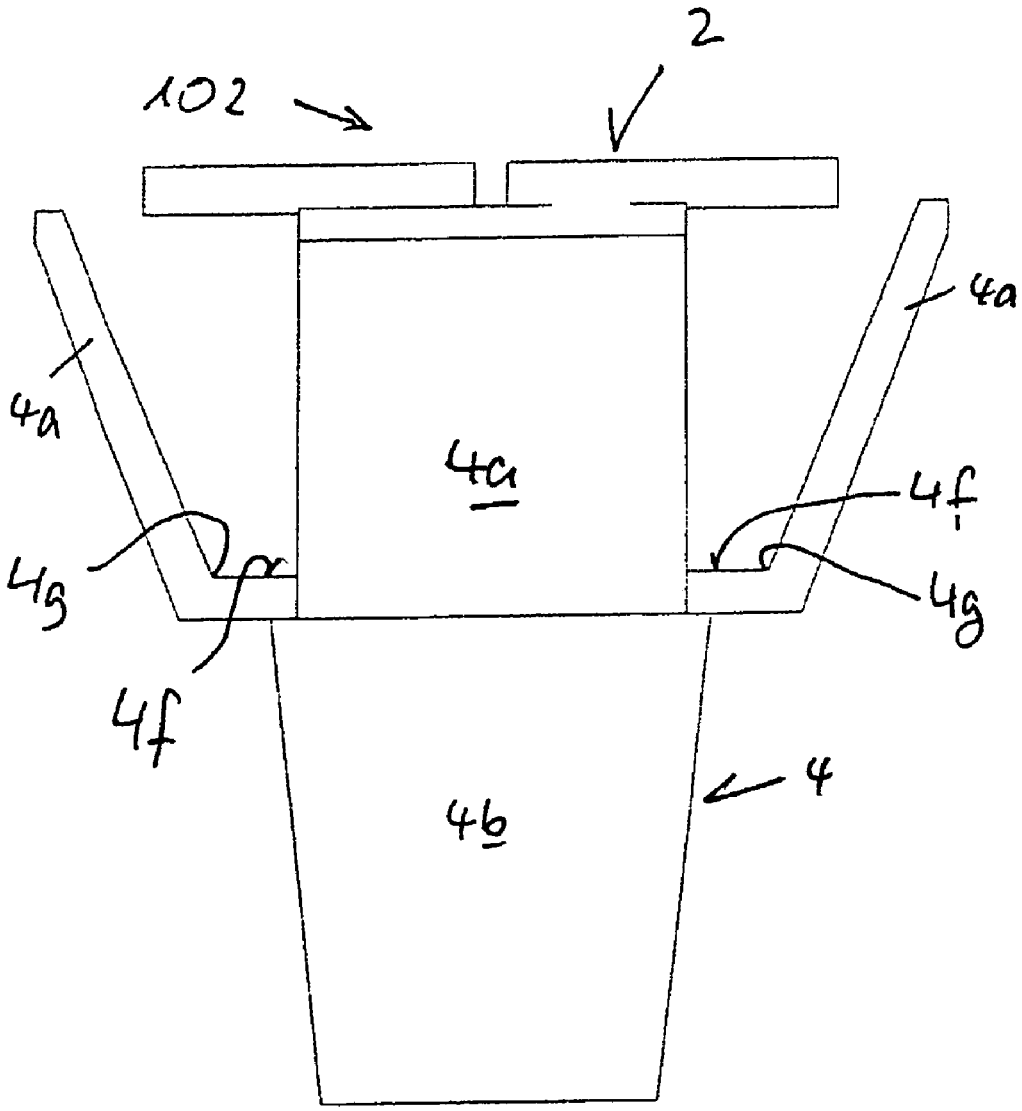
FIG. 3: shows a side view of the platform as illustrated in FIG. 2, with an antenna element arranged on it.

FIG. 3 once again shows a detail view from the side of the platform 4 as shown in FIG. 2, with a vector dipole antenna element 2 arranged on it. FIG. 3 shows in particular that the platform 4 has a closed structure with four side walls 4*b*, with the four flaps 4*a* (which have already been mentioned) in the illustrated exemplary embodiment running obliquely upwards and extending outwards from the level of the upper platform plane 4*f*. The antenna element 2 is then mounted by its base on the upper platform or plateau planes.

In this case, as can be seen from FIG. 3 and particularly in conjunction with FIGS. 1 and 2 as well, the platform has an approximately square structure in a plan view, whose side boundaries are parallel to the half-dipole components of the vector dipole 2. The side walls (flaps) 4*b* which project upwards from these side separations of the platform do not in the illustrated exemplary embodiment run at right angles to the plane of the platform, so that they do not run at right angles to the reflector plane E either, but are positioned such that they run at an angle outwards. This angle is preferably more than 10°, and is preferably less than 40°. In particular, this angle α is around 20° (FIG. 2) with respect to the vertical. Apart from this, the side walls 4*a* are also not closed circumferentially, but are open in the corner areas, as can be seen in particular from the plan view shown in FIG. 1.

However, this angle α may also assume any other desired values, so that the flaps or the extensions 4*a* in the form of flaps may even lie on the plane of the platform upper face or of the plateau 4*f* formed in this way, and can thus be interpreted as a form of auxiliary reflector extension. Furthermore, these flaps 4*a* may even be angled downwards with respect to the platform upper face 4*f*, for example virtually up to an angle of 90°. In other words, the angle between the flaps 4*a* and a plane which is parallel to the reflector plane E may vary between ±85° or ±80° and 0°, at which the flaps are aligned parallel to the reflector plane.

The longitudinal extent of the flaps starting from the platform 4 to their free end is preferably λ/10 to λ, with the lowest value of λ corresponding to the wavelength for the upper band limit (highest frequency) of the upper transmitted frequency band, and the maximum value of λ corresponding to the wavelength for the lower band limit (lowest frequency) of the upper frequency band to be transmitted. The same dimension rules also apply to the transverse extent of the flaps, with these values reflecting preferred values.

The flaps are preferably formed and aligned symmetrically on each platform. However, a certain amount of asymmetry may in some cases be advantageous, in terms of the angle of their alignment compared with the other flaps on the platform, or their dimensions. Finally, however, the flaps may also be completely omitted, or may be closed to form a circumferential boundary or side wall 4*b*.

Figure 4:
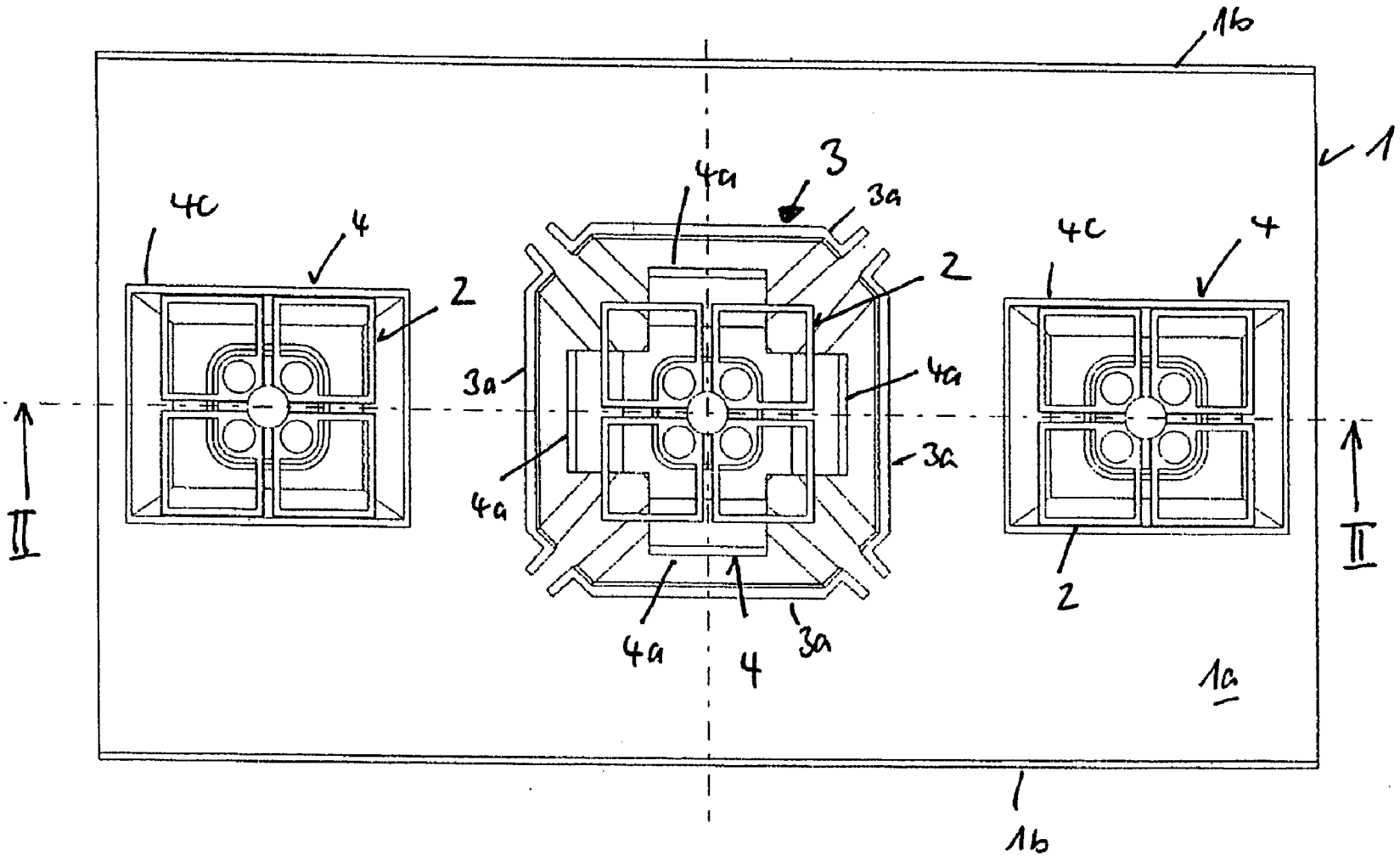
FIG. 4: shows a plan view of a detail of a second embodiment of the antenna according to the invention.

FIG. 4 shows a plan view of a second embodiment of the antenna according to the invention. In the embodiment shown in FIG. 4, the same antenna elements 2 and 3 are used as in FIG. 1, and the antenna elements are also arranged in the same way as in the embodiment in FIG. 1, in a plan view. In contrast to the embodiment shown in FIG. 1, however, the left-hand and right-hand first antenna elements are also arranged on a platform, with this platform having a closed, essentially rectangular, platform surface 4*c* with a corresponding boundary 4*d*, which frames and surrounds the platform surface. The platform on which the central antenna element 2 is arranged also corresponds to the platform which is also used in the embodiment shown in FIG. 1.

Figure 5:
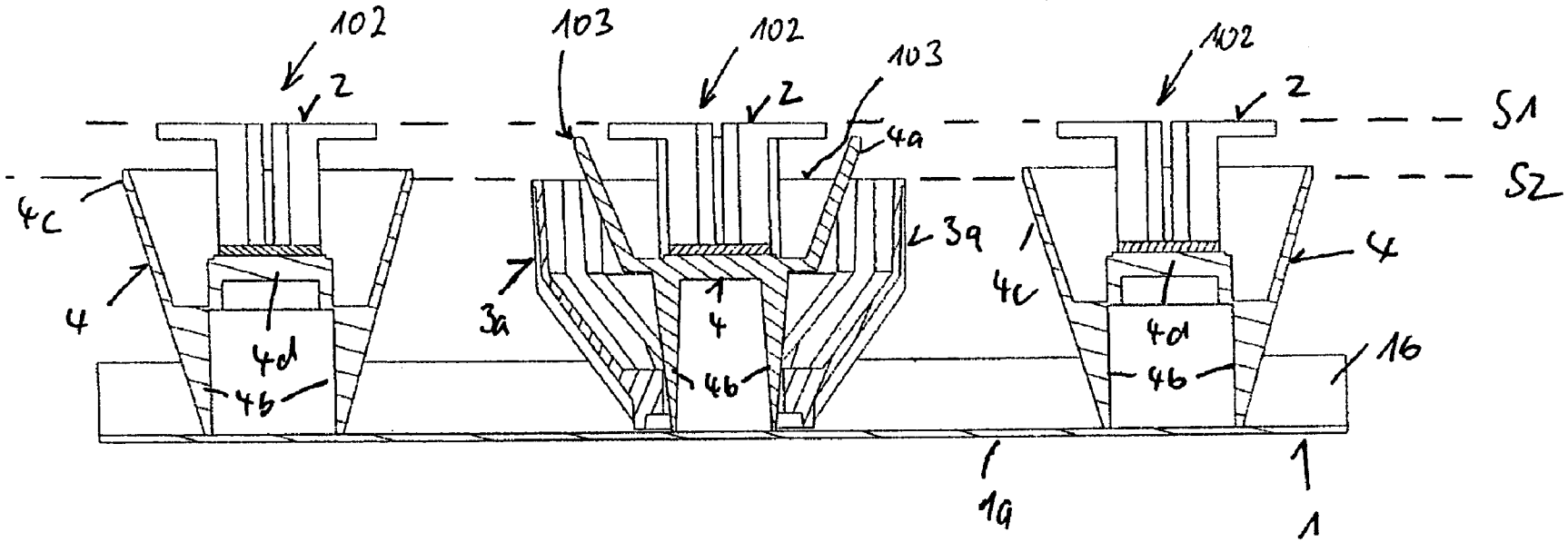
FIG. 5: shows a section view along the line II—II in FIG. 4.

FIG. 5 shows a section view along the line II—II in FIG. 4. This shows in particular that the left-hand and right-hand platforms are identical, and have a different shape to the central platform. The left-hand and right-hand platforms essentially form a tower with side walls which run obliquely upwards, and with the platform together with the circumferential closed side wall boundary 4*c* being formed on the upper face of the tower. Furthermore, the left and right holders have raised base elements 4*d*, on each of which one first antenna element 2 is positioned. The left-hand and right-hand platforms have a cavity in the lower area, analogously to the central platform, which is bounded by side walls 4*b* which run to a point. In contrast to the embodiment shown in FIG. 1, there are only two radiation planes S1 and S2 in the embodiment shown in FIG. 5, with all three first antenna elements 2 being arranged on the first radiation plane S1. In contrast to FIG. 5, the arrangement can also be chosen such that the platform height of the outer antenna elements or antenna element structures 102 is, for example, slightly lower or higher than the antenna elements or antenna element structure 102 of the antenna element 2, which is arranged centrally in the antenna element 3, so that the antenna element plane S3 for those antenna elements 2 which are not arranged within the antenna elements for the low frequency band is not the same as the antenna element plane S1.

Figure 6:
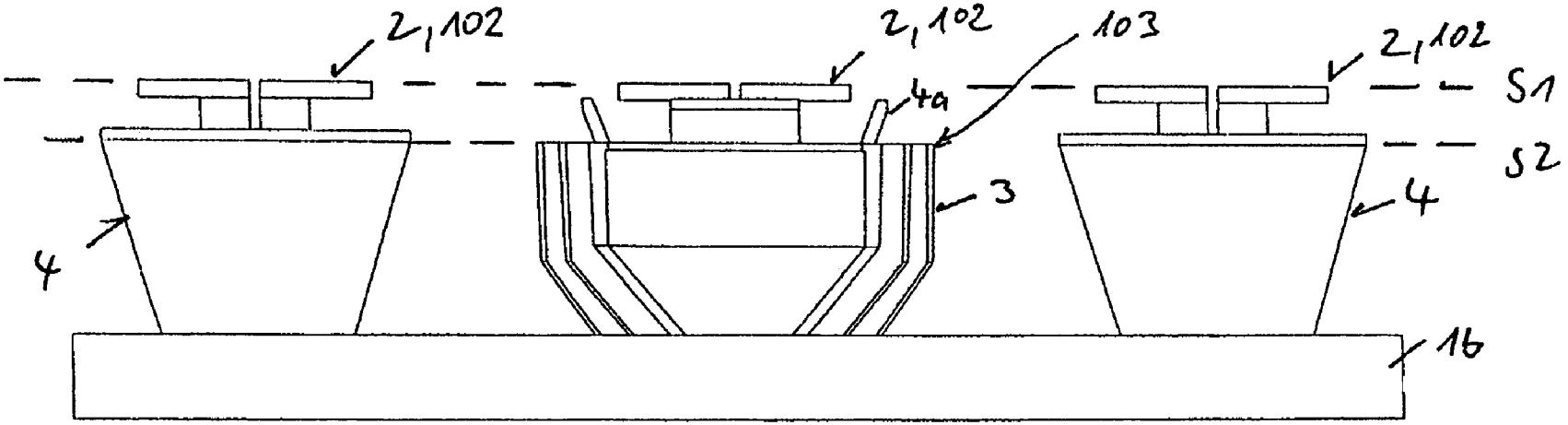
FIG. 6: shows a non-sectioned side view of the antenna shown in FIG. 5.

FIG. 6 shows the same side view as in FIG. 5, but with the side view in FIG. 6 not being sectioned. This, in particular, shows that the left-hand and right-hand platforms have closed side walls which run obliquely, so that they form a tower which is closed at the sides, that is to say in a circumferential direction and is open at the top, and on whose plateau or platform surface 4*d* the corresponding antenna element is arranged.

Figure 7:
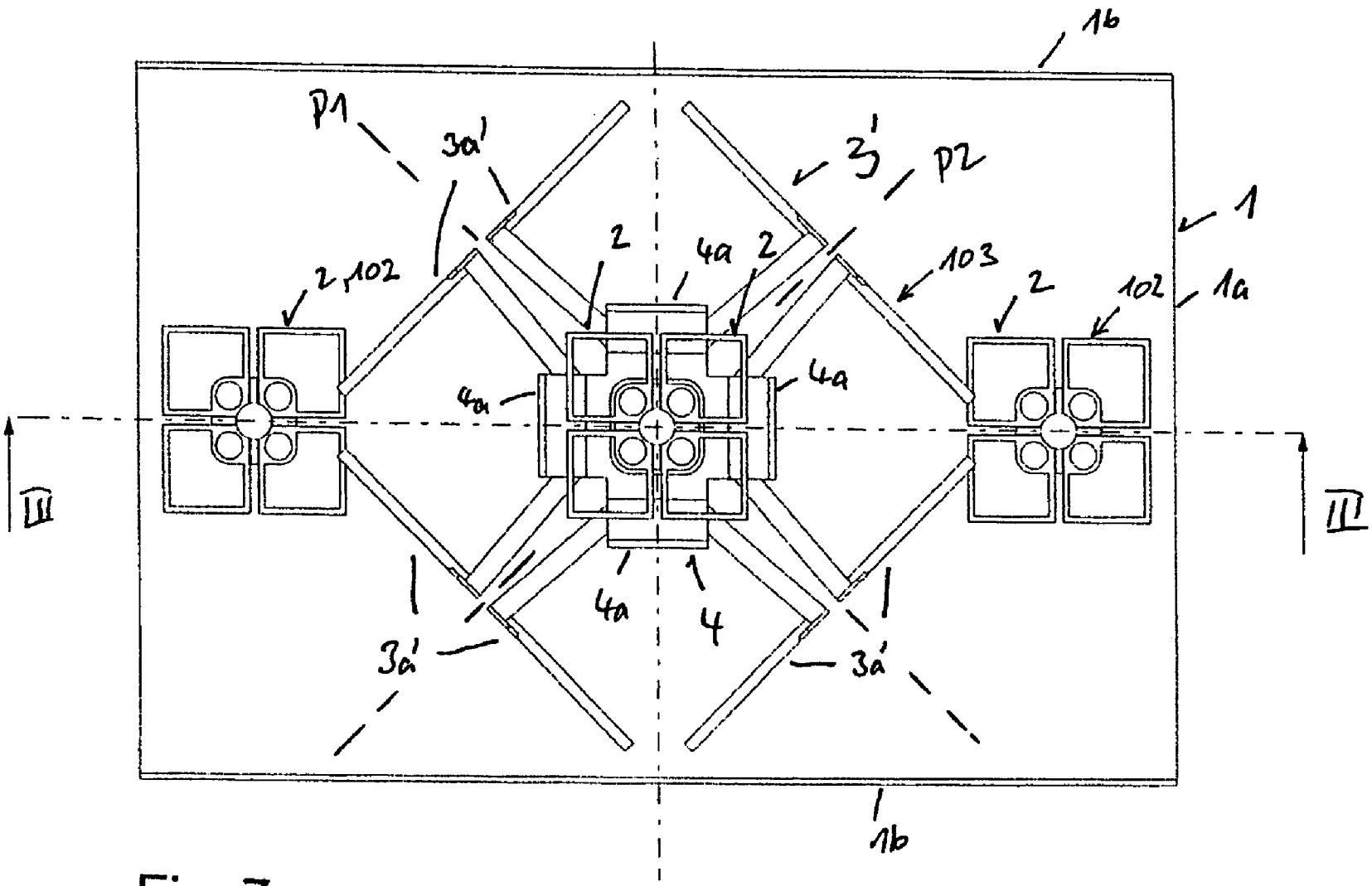
FIG. 7: shows a plan view of a detail of a third embodiment of the antenna according to the invention.

FIG. 7 shows a plan view of a third embodiment of the antenna according to the invention. The antenna shown in FIG. 7 differs from the antenna shown in FIG. 1 by the use of a different type of second antenna element. Otherwise, the embodiment shown in FIG. 7 corresponds to the embodiment shown in FIG. 1, so that it will not be described in detail.

In FIG. 7, a dipole square 3' is used instead of a cup-shaped antenna element 3, and has four dipoles which are in the form of rods and each comprise two dipole halves 3*a*'. The individual dipoles in this case run at an angle of 45° to the side walls 1*b* of the reflector 1. This means that, analogously to the cup-shaped antenna element in FIG. 1, the dipole square transmits and receives with the +45° polarization P1 and the −45° polarization P2. The design of antenna elements in the form of dipole squares is well known from the prior art. By way of example, reference is made to the document DE 198 23 749 A1, with this reference including its entire disclosure content being part of this application.

Figure 8:
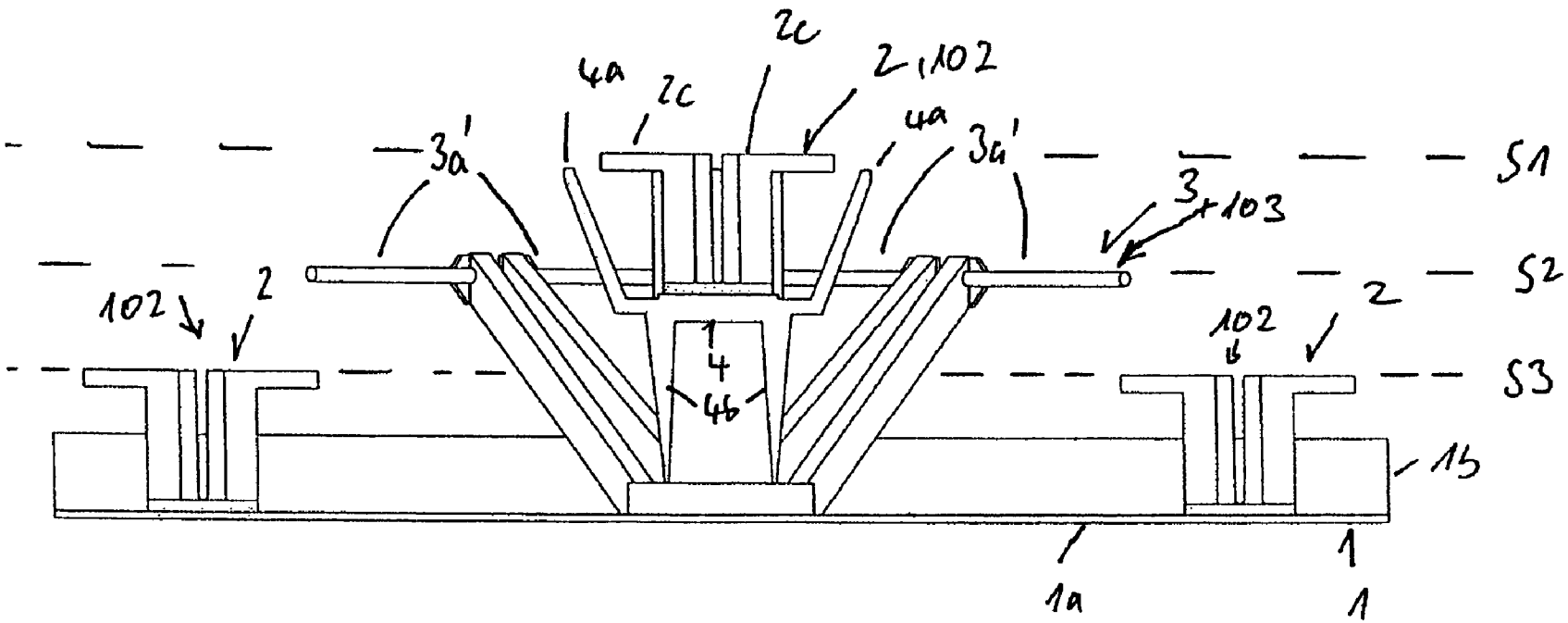
FIG. 8: shows a section view along the line III—III in FIG. 7.

FIG. 8 shows a side view from FIG. 7, sectioned along the line III—III. As can be seen, analogously to FIG. 2, there are three different radiation planes S1, S2 and S3. The left-hand and right-hand first antenna elements 2 are arranged on the lowermost radiation plane S3. The dipoles of the dipole antenna element 3 are located on the radiation plane S2, which is higher than the radiation plane S3. The dipoles for the antenna element 2, which is arranged on the platform 4, are located on the uppermost radiation plane S1. As can be seen from FIG. 8, the distance between the radiation planes S1 and S2 is considerably greater than in the embodiment shown in FIG. 2. In this case, it should be noted that, in the embodiment shown in FIG. 8, it is also possible for the left-hand and right-hand first antenna elements likewise to be positioned on a platform, so that they are also located on the radiation plane S1. In this case, the same platform can be used as that which is used in FIG. 5 for the left-hand and right-hand first antenna element, although the height of the platform can be matched to the height of the plane S1 in FIG. 8.

Figure 9:
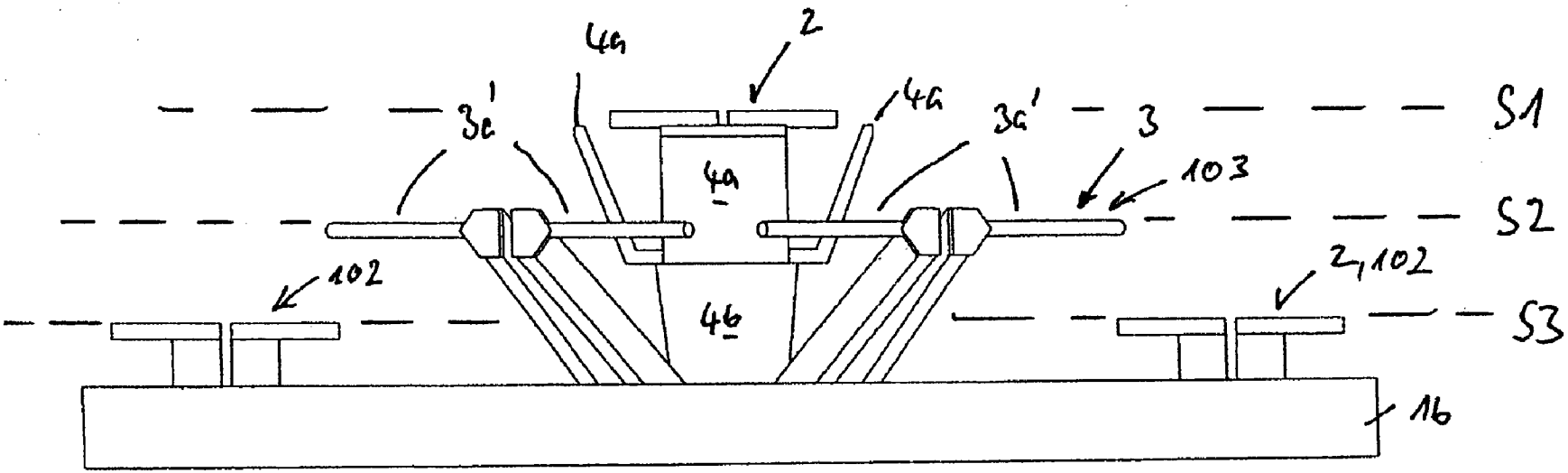
FIG. 9: shows a non-sectioned side view of the antenna shown in FIG. 8.

FIG. 9 shows a side view, which has not been sectioned, analogous to FIG. 8. This figure shows that the central platform 4 is identical to the platform shown in FIG. 3. However, in this case as well, the platforms for the outer antenna elements 102 may be designed slightly in height, such that the antenna element height S3 on the antenna element height S1 differ at least slightly from one another with respect to the reflector plane E.

In contrast to the illustrated exemplary embodiments, the antenna elements 2 for the higher frequency band also need not be designed as vector dipoles, but may, for example, be designed as dipole squares (similar to the antenna element type in the exemplary embodiment shown in FIGS. 7 to 9) or in the form of dipole cruciforms. In this respect, there are no restrictions to the use of specific dipole antenna elements or dipole antenna element shapes.

The radiation planes S1, S2 and S3 which have been explained are in principle aligned parallel to the reflector plane E. However, in individual cases, the antenna elements or antenna element structures 102, 103 could possibly also differ from this plane, and be inclined to it, by an angle of less than ±5°. In this context, the antenna element planes S1, S2 and S3 could possibly also differ, at least over a part of the length of the reflector, from the reflector plane by an angle such as this of less than ±5°.

Reference is continuously made to the fact that the explained distances between the radiation planes and thus the distances between the antenna elements and the antenna element structure 102, 103 are at the distances which have been explained, at least in the area of the relevant antenna elements 2, 3, 3'. This is because, in principle, it is also possible to use an antenna arrangement which comprises two or more reflector sections which have reflector sections at an angle to one another in an angle range, for example in the circumferential direction, in order to allow the antenna elements which are seated on them to transmit at different azimuth angles.

The invention claimed is:

1. An antenna, in particular a mobile radio antenna, for operation in at least two frequency bands, having the following features:

two or more dipole antenna elements are provided and are arranged in front of a reflector, the two or more dipole antenna elements have antenna elements or antenna element structures, at least one dipole antenna element of the two or more dipole antenna elements is provided which transmits and receives in a lower frequency band, and at least one antenna elements is provided which transmits and receives in a higher frequency band, and further including:

a distance between the antenna element structure, the antenna elements or the antenna element top of at least one dipole antenna elements for the higher frequency band is at the distance from a reflector plane which corresponds to at least 75% and at most 150% of the distance between the antenna element structure, the antenna element or the antenna element top of at least one dipole antenna element for the lower frequency band and the reflector plane, and/or the distance between the antenna element structure, the antenna elements or the antenna element top of at least one dipole antenna element for the higher frequency band is at a distance from the reflector plane which is greater than 0.4λ and is preferably less than 2λ with respect to a mid-frequency of the antenna element for the higher frequency.

2. The antenna according to claim 1, including the following features:

the antenna elements or the antenna element structure of at least one antenna element for the higher frequency range is on one radiation plane, and the antenna elements or the antenna element structure of at least one dipole antenna element for a lower frequency range are or is on a second radiation plane, with the first radiation plane being further away from the reflector plane than the second radiation plane.

3. The antenna according to claim 1, including the following features:

the antenna elements or the antenna element structure of at least one antenna element for the higher frequency range is on one radiation plane, and the antenna elements or the antenna element structure of at least one dipole antenna element for a lower frequency range are or is on a second radiation plane, with the first radiation plane and the second radiation plane being essentially at the same distance from the reflector plane.

4. The antenna according to claim 1, wherein one or more first antenna elements which are on the first radiation plane are in each case arranged on a platform whose area is larger than the base cross section of the associated dipole antenna element, which is connected to the reflector and is preferably at least partially electrically conductive.

5. The antenna according to claim 4, wherein, on its upper face, the platform has an electrically conductive and preferably metallic platform upper face on which a first antenna element is positioned.

6. The antenna according to claim 5, wherein at least a part of the platform upper face in each case comprises two or more flaps which run at right angles and/or obliquely to the reflector plane and are arranged offset with respect to one another in the circumferential direction in a plan view.

7. The antenna according to claim 5, wherein the flaps are aligned at an undefined angle between −90° and +90°, in particular of less than ±80°, with respect to a plane which is parallel to the reflector plane.

8. The antenna according to claim 5, wherein the flaps which are provided on the platform or on the platform plateau in the circumferential direction are at a distance from one another or are connected to one another to form a circumferential boundary wall.

9. The antenna according to claim 4, wherein, in a plan view of the reflector, the first antenna element, which is arranged on the platform, is located within the boundary of the platform.

10. The antenna according to claim 4, wherein one or more first antenna elements which is or are arranged on the first radiation plane is or are formed integrally with the associated platform.

11. The antenna according to claim 4, wherein the platform surface or the platform plateau is rectangular, square, polygonal with n sides or else curved, in particular circular, in a plan view.

12. The antenna according to claim 4, wherein the platform surface or the platform plateau has a longitudinal size in a plan view parallel to the X direction or vertical direction of the reflector and/or a transverse extent which is at least $\lambda/4$ and at most $\lambda$, with the minimum value of $\lambda$ being the wavelength at the band lower limit (lower frequency) of the upper transmitted frequency band, and the maximum value of $\lambda$ being at the band upper limit (maximum frequency) of the upper transmitted frequency band.

13. The antenna according to claim 4, wherein the flaps have a longitudinal and/or a transverse extent between their face on which they are linked to the platform to their free end remote from this which is between $\lambda/10$ and $\lambda$, with the lowest value of $\lambda$ corresponding to the wavelength at the upper band limit (highest frequency) of the upper transmitted frequency band, and the maximum value of $\lambda$ corresponding to the wavelength at the lower band limit (lowest frequency) of the upper frequency band to be transmitted.

14. The antenna according to claim 1, wherein, in a plan view of the reflector, one or more first antenna elements are each arranged essentially centrally in the second antenna element, in a plan view.

15. The antenna according to claim 1, wherein, in a plan view of the reflector, one or more first antenna elements are each arranged essentially centrally between adjacent second antenna elements.

16. The antenna according to claim 1, wherein one or more further radiation planes (S3) exist, on which the radiation edges (3*f*) and/or the elements (2*d*, 3*a*'), which are in the form of rods, of first and/or second antenna elements are arranged.

17. The antenna according to claim 1, wherein one or more second antenna elements are dual-polarized dipole squares (3') formed from four dipoles.

18. The antenna according to claim 17, wherein, in a plan view of the reflectors, a first antenna element is in each case arranged in one or more of the dipole squares and/or of the cup-shaped antenna elements.

19. The antenna according to claim 1, wherein one or more second antenna elements are dual-polarized, cup-shaped antenna elements which have radiation edges (3*f*) or elements in the form of rods at the end which is remote from the reflector.

20. The antenna according to claim 19, wherein the cup-shaped antenna elements have two or more surface elements over their entire surface, which run obliquely and/or at right angles to the reflector plane and whose boundary edge remote from the reflector plane is a radiation edge.

21. The antenna according to claim 1, wherein one or more first antenna elements are dual-polarized cruciform dipoles and/or vector dipoles.

22. The antenna according to claim 1, wherein the reflector has side walls (1*b*) which run in the longitudinal direction of the reflector and extend obliquely and/or at right angles from the reflector plane, with the two or more antenna elements being arranged between the side walls.

23. The antenna according to claim 1, wherein the frequency of the lower frequency band is between 800 MHz and 1000 MHz and the frequency of the upper frequency band is between 1700 MHz and 2500 MHz.

24. The antenna according to claim 1, wherein a large number of first and second antenna elements are arranged alongside one another in the longitudinal and/or transverse direction of the reflector, with a first antenna element being arranged essentially centrally above each second antenna element, and a first antenna element being arranged essentially centrally between each pair of adjacent second antenna elements.

25. The antenna according to claim 1, wherein all of the first antenna elements are arranged on the first radiation plane, and all of the second antenna elements are arranged on the second radiation plane.

26. The antenna according to claim 1, wherein the antenna frequency bands are in the GSM, CDMA and/or UMTS mobile radio frequency range.

27. The antenna according to claim 1, wherein the first radiation plane as well as the second radiation plane are inclined essentially parallel to the reflector plane, or at most at an angle of ±5° to reflector plane.

* * * * *